US007766717B2

(12) United States Patent
Shapiro

(10) Patent No.: US 7,766,717 B2
(45) Date of Patent: Aug. 3, 2010

(54) SYSTEM FOR REPRESENTING AN AUTONOMOUS ENTITY

(76) Inventor: Ted Shapiro, 55 W. 11th St., Apt. 6C, New York, NY (US) 10011

( * ) Notice: Subject to any disclaimer, the term of this patent is extended or adjusted under 35 U.S.C. 154(b) by 43 days.

(21) Appl. No.: 12/053,610

(22) Filed: Mar. 23, 2008

(65) Prior Publication Data

US 2009/0239443 A1 Sep. 24, 2009

(51) Int. Cl.
*A63H 33/30* (2006.01)
*A63H 33/26* (2006.01)
*G09F 19/02* (2006.01)

(52) U.S. Cl. ..... 446/236; 446/238; 446/229; 40/409

(58) Field of Classification Search ..... 446/236, 446/238, 229, 266, 33, 267, 484, 175; 40/409, 40/410, 411, 414, 455, 906
See application file for complete search history.

(56) References Cited

U.S. PATENT DOCUMENTS 2,922,253 A * 1/1960 Carter ..... 446/303
4,180,932 A * 1/1980 Millard ..... 40/455
5,090,936 A * 2/1992 Satoh et al. ..... 446/175
5,146,702 A 9/1992 Belokin, Jr.
5,484,630 A * 1/1996 McCall et al. ..... 428/11
5,823,844 A * 10/1998 Markowitz ..... 446/175
6,038,812 A 3/2000 Belokin et al.
6,045,430 A * 4/2000 How ..... 446/236
6,161,317 A * 12/2000 Wang ..... 40/406
6,227,929 B1 5/2001 Nelson et al.
6,722,064 B2 * 4/2004 Knapp et al. ..... 40/410
6,743,072 B2 6/2004 Nelson et al.
6,962,015 B2 * 11/2005 Tyler et al. ..... 40/427

* cited by examiner

*Primary Examiner*—Nini Legesse
(74) *Attorney, Agent, or Firm*—Steven M. Greenberg, Esq.; Carey, Rodriguez, Greenberg & Paul, LLP

(57) ABSTRACT

A system is provided for representing an autonomous entity, which may be a winged entity. In a particular embodiment, the system includes a vessel having an interior that is viewable from outside the vessel. The system further includes a rotational drive system, a flexible shaft connected to the rotational drive system for rotation by the rotational drive system, and a display object positioned in the interior of the vessel and connected to the flexible shaft at a position that is spaced from the rotational drive system. In a particular embodiment, the display object has a plurality of wings, including a first wing and a second wing that is generally opposed to the first wing. Rotation of the flexible shaft causes the display object to move within the vessel.

40 Claims, 5 Drawing Sheets

| | ACTION | # VARIANTS |
|---|---|---|
| 65, 65a | FLY | 2 |
| 65, 65b | FLAP | 5 |
| 65, 65c | FLUTTER | 2 |
| 65, 65d | REST | 1 |
| 65, 65e | FEED | 1 |
| 65, 65f | LOVE | 1 |
| 65, 65g | SNOOZE | 1 |
| 65, 65h | DANCE | 1 |
| 65, 65i | QUESTION | 3 |

FIG. 5

66, 66a

| | ACTION | ANGULAR DISTANCE / REP |
|---|---|---|
| 65, 65a | FLY | 20 full steps |
| 65, 65b | FLAP | 32 half steps |
| 65, 65c | FLUTTER | 10 or 16 full steps |
| 65, 65d | REST | - |
| 65, 65e | FEED | 6 half steps |
| 65, 65f | LOVE | 7 half steps |
| 65, 65g | SNOOZE | 32 half steps |
| 65, 65h | DANCE | 80 half steps |
| 65, 65i | QUESTION | 20 full staps |

FIG. 6a 66, 66b

| | ACTION | # REPS / ACTION |
|---|---|---|
| 65, 65a | FLY | 3-8 |
| 65, 65b | FLAP | 1-5 |
| 65, 65c | FLUTTER | 1-11 |
| 65, 65d | REST | 1-6 |
| 65, 65e | FEED | - |
| 65, 65f | LOVE | - |
| 65, 65g | SNOOZE | - |
| 65, 65h | DANCE | - |
| 65, 65i | QUESTION | 7 or 20 |

FIG. 6b 66, 66c

| | ACTION | MOTOR SPEED |
|---|---|---|
| 65, 65a | FLY | 2-5 |
| 65, 65b | FLAP | 3-35 |
| 65, 65c | FLUTTER | 2-4 |
| 65, 65d | REST | - |
| 65, 65e | FEED | 10-30 |
| 65, 65f | LOVE | 2-4 |
| 65, 65g | SNOOZE | 150-175 |
| 65, 65h | DANCE | 5-15 |
| 65, 65i | QUESTION | 5 |

FIG. 6c

SYSTEM FOR REPRESENTING AN AUTONOMOUS ENTITY

FIELD OF THE INVENTION

The present invention relates to amusement devices with moving display objects, and more particularly to amusement devices with moving display objects that resemble a fictional or real autonomous entity, which may be a winged entity.

BACKGROUND OF THE INVENTION

There have been several amusement devices proposed in the past that provide a display object that is moved by a motor and that is configured to resemble a living entity such as a butterfly. However, the movement of the display object may be limited in one or more ways and for a variety of reasons, there is typically limited realism in the ability of the display object to appear to be a living entity. For example, some amusement devices have the display object mounted on a clearly visible shaft that is connected to a remotely positioned motor. In addition, some of these amusement devices offer little in the way of interaction with a user, thereby limiting the range of ways such devices can be used to the amusement of the owner.

Consequently, there is a need for an amusement device that provides a moving display object that has enhanced realism. There is also a need for an amusement device that has increased capability to interact with a user.

SUMMARY OF THE INVENTION

In one aspect, the present invention is directed to a system for representing an autonomous entity, that may be a winged entity. In a particular embodiment, the system includes a vessel having an interior that is viewable from outside the vessel. The system further includes a rotational drive system, a flexible shaft connected to the rotational drive system for rotation by the rotational drive system, and a display object positioned in the interior of the vessel and connected to the flexible shaft at a position that is spaced from the rotational drive system. The display object has a plurality of wings, including a first wing and a second wing. At least one of the wings is movable as a result of rotation of the flexible shaft. Rotation of the flexible shaft causes the display object to move and resemble an autonomous winged entity within the vessel. It is optionally possible that the display object could include some other feature that is movable by the rotation of the flexible shaft instead of any of the wings. For example, the display object could optionally include one or more arms and/or legs that are movable by the rotation of the flexible shaft. The display object may or may not have any wings.

In a second aspect, the invention is directed to a system for representing an autonomous entity, which may be a winged entity, and which includes a motor, a controller connected to the motor, a flexible shaft connected to the motor and a display object connected to the flexible shaft. The display object has a first feature and a second feature. The first and second features may be wings, or some other features such as arms or legs. Rotation of the flexible shaft causes at least one of the first and second features to move. The controller is configured to control the rotation of the flexible shaft in such a way that the display object carries out a plurality of different actions, thereby resembling an autonomous entity. Optionally, features may be wings and the actions may include an action whereby the controller causes the at least one of the first and second wings to rotate through a plurality of revolutions. Optionally, the actions may include an action whereby the controller causes the at least one of the first and second wings to reciprocate. Optionally, each action may be controlled using a plurality of parameters each having a value, wherein the value for at least one of the parameters is generated using a random number generator.

In a third aspect, the invention is directed to a system for representing an autonomous entity which may be a winged entity. In a particular embodiment, the system includes a vessel having an interior that is viewable from outside the vessel. The system further includes a rotational drive system, a flexible shaft connected to the rotational drive system for rotation by the rotational drive system, and a display object positioned in the interior of the vessel and connected to the flexible shaft at a position that is spaced from the rotational drive system. The display object has a first feature which may be a wing and a second feature which may be a wing. Rotation of the flexible shaft causes the display object to move and resemble an autonomous entity within the vessel. A tap sensor system is provided and is configured to signal a controller when a user taps on the vessel. The controller can alter the behaviour of the display object in the vessel based on signals sent by the tap sensor system.

In a fourth aspect, the present invention is directed to a system for representing an autonomous winged entity. In a particular embodiment, the system includes a rotational drive system, a flexible shaft connected to the rotational drive system for rotation by the rotational drive system, and a display object connected to the flexible shaft at a position that is spaced from the rotational drive system. The display object has a plurality of wings, including a first wing and a second wing. Rotation of the flexible shaft causes the display object to move and resemble an autonomous winged entity. One or more landing surfaces may be provided for the display object to rest on. Alternatively, the display object may remain substantially permanently airborne.

In a fifth aspect, the present invention is directed to a system for representing an entity that moves in synchronization with sound. In a particular embodiment, the sound is in the form of digital signals that are outputted via an audio speaker that is part of the system. The system further includes a stepper motor, a controller operatively connected to the stepper motor, a flexible shaft connected to the stepper motor for rotation by the stepper motor, and a display object connected to the flexible shaft. The controller is configured to control rotation of the stepper motor in synchronization with the digital signals.

In a sixth aspect, the present invention is directed to a system for representing a butterfly. The system includes a motor, a controller for controlling the operation of the motor, a flexible shaft connected to the motor and a display object connected to the flexible shaft. The display object includes a plurality of wings at least one of which is movable in response to the rotation of the flexible shaft. The controller is configured to operate the motor to turn the at least one wing so as to mimic selected actions of a butterfly.

In a seventh aspect, the invention is directed to an interactive system including a display object that is movable by a rotational drive system through a flexible shaft. A user can interact with the display object to alter the actions taken by the display object. In a particular embodiment, the user can interact with the display object by tapping on a vessel in which the display object is positioned.

BRIEF DESCRIPTION OF THE DRAWINGS

The present invention will now be described by way of example only with reference to the attached drawings, in which:

FIG. 5 is a table showing a plurality of actions that are available for the system shown in FIG. 1;

FIGS. 6*a*-6*c* are tables showing the exemplary values for selected motor parameters that can be controlled to carry out the actions shown in FIG. 5.

DETAILED DESCRIPTION OF THE INVENTION

Figure 1:
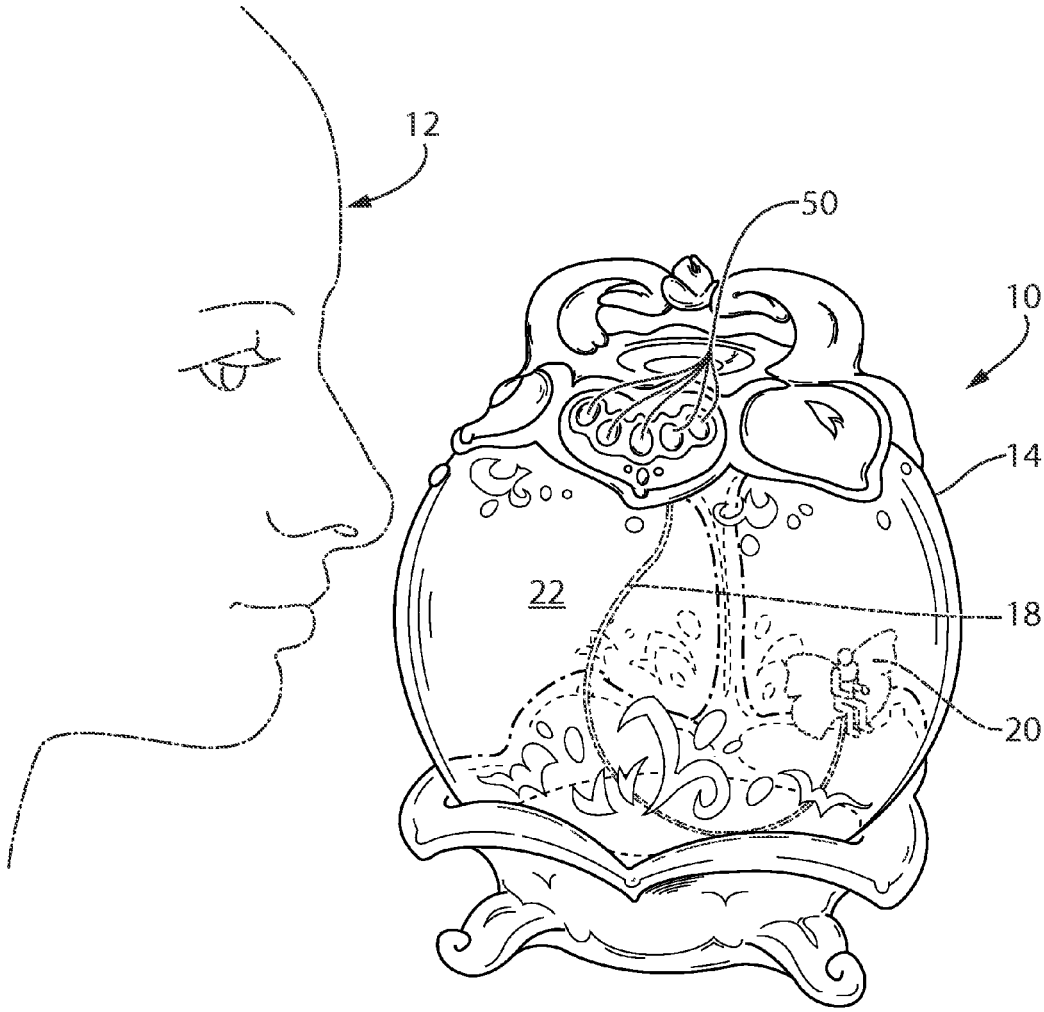
FIG. 1 is a perspective view of a system for representing an autonomous winged entity in accordance with an embodiment of the present invention.

Reference is made to FIG. 1, which shows a system 10 for representing an autonomous winged entity in accordance with an embodiment of the present invention. The system 10 for representing an autonomous winged entity may represent any suitable type of fictional or real autonomous winged entity, such as, for example, a fairy, a butterfly, a dragon or a bird, for the amusement of a user 12.

Figure 2:
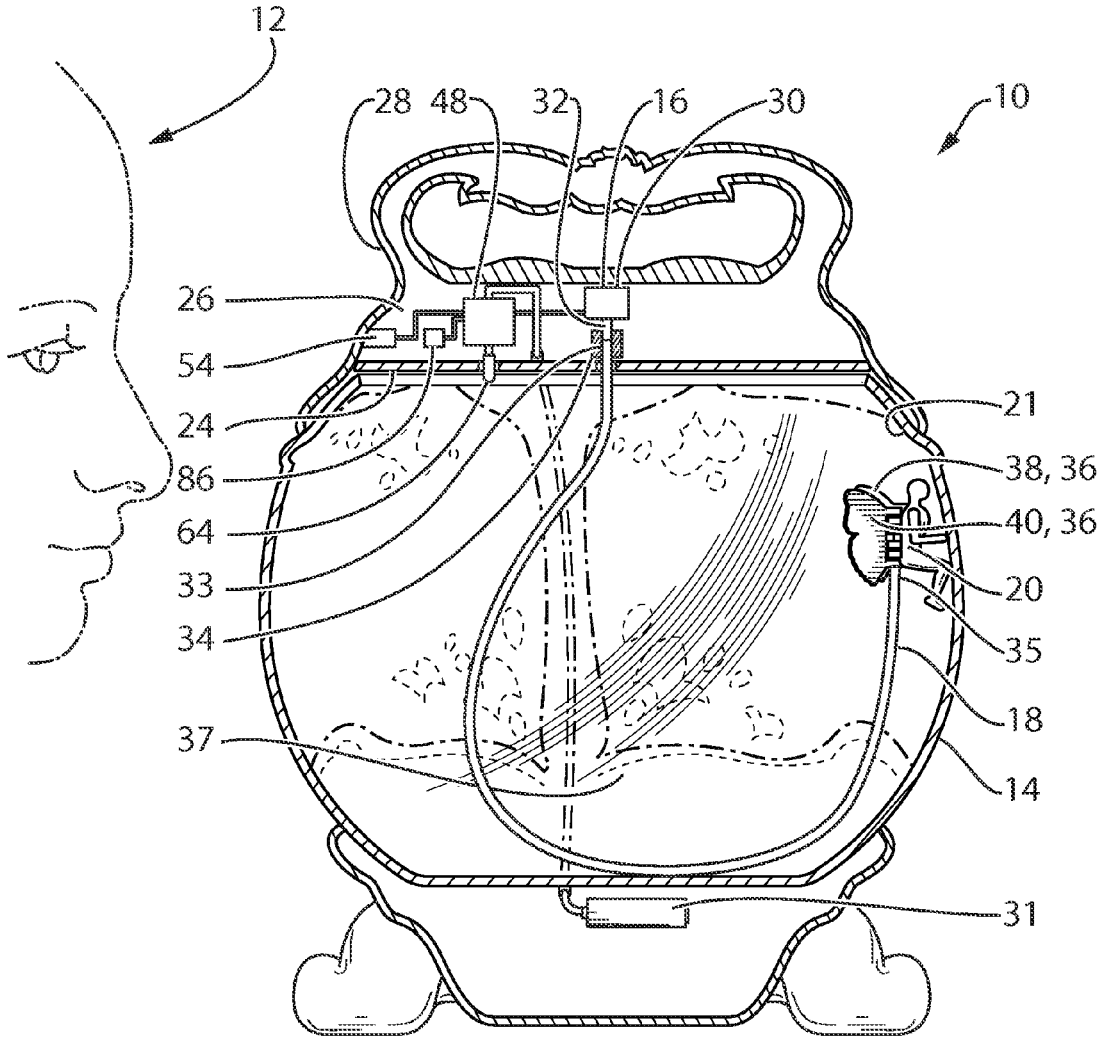
FIG. 2 is a sectional view of the system shown in FIG. 1.

Referring to FIG. 2, the system 10 for representing an autonomous winged entity may include a vessel 14, a rotational drive system 16, a flexible shaft 18 that is connected to the rotational drive system 16 for rotation by the rotational drive system 16, and a display object 20 positioned in the vessel 14.

The vessel 14 has a vessel wall 21 that defines an interior 22. The interior 22 is viewable by the user 12 from outside the vessel 14. In a preferred embodiment, at least a portion of the vessel wall 21 is made from a transparent material, such as glass or a suitable transparent polymeric material.

The shape of the interior 22 of the vessel 14 may be generally spherical as shown in FIG. 1. Alternatively, the vessel 14 may have any other suitable shape, such as, for example, generally rectangular.

Referring to FIG. 2, the vessel 14 includes a drive system enclosure 24 that defines a drive system enclosure cavity 26. The rotational drive system 16 is preferably positioned in the drive system enclosure cavity 26 so as to be obscured from view by the user 12, so as to enhance the appearance that the display object 20 is an autonomous winged entity in the vessel 14.

The drive system enclosure 24 may make up a lid 28 for the vessel 14, as shown in FIG. 1. Hiding the rotational drive system 16 in what may appear as an ordinary component of the vessel 14 (ie. a lid 28) further obscures the presence of the rotational drive system 16.

The rotational drive system 16 is configured to impart rotary motion to the flexible shaft 18. The rotational drive system 16 may be made up of any suitable kind of drive means, such as, for example, a motor 30. The motor 30 may be any suitable kind of motor, such as, for example, a DC, bipolar stepper motor or a DC, unipolar stepper motor. In a preferred embodiment, the motor 30 is powered by one or more batteries 31 mounted in a battery compartment that is incorporated into a base 29 of the vessel 14.

The motor 30 may have any selected properties. For example, in embodiments where the motor 30 is a stepper motor, the motor 30 may have any selected step size, such as an 18-degree step size. In embodiments where the motor is a bipolar stepper motor, the motor 30 may be movable in half steps for increased positional control. It will be understood that half-stepping of the motor 30 is not a requirement, and further that the motor 30 need not be a bipolar stepper motor, or a stepper motor at all.

The motor 30 may be operatively connected to the flexible shaft 18 in any suitable way. For example, the motor 30 may have an output shaft, as shown at 32. The output shaft 32 is connected to an end 33 of the connected shaft 18, which may be referred to as the connected end 33 of the flexible shaft 18. The connection between the output shaft 32 and the flexible shaft 18 may be by some suitable means, such as by a grippy, resilient polymeric sleeve 34. Instead of connecting the flexible shaft 18 and motor output shaft 32 by means of the sleeve 34, a magnet (not shown) could be provided on one of the flexible shaft 18 and motor output shaft 32 for magnetically attaching to a magnet or paramagnetic material on the other of the flexible shaft and motor output shaft 32. Providing a magnetic connection would facilitate interchanging a display object 20 with another display object (not shown), which may have a different shape or coloration, thereby enhancing the appeal of the system 10 to the user.

In a preferred embodiment, the output shaft 32 and the flexible shaft 18 are connected end-to-end so that they are co-axial so as not to introduce an eccentricity into the rotation of the connected end 33 of the flexible shaft 18. However it is alternatively possible for the connected end 33 of the flexible shaft 18 to be mounted to the output shaft 32 of the motor 30 with some overlap between them longitudinally.

It is at least theoretically possible to provide a motor 30 with an output shaft 32 that is a hollow shaft so that the connected end 33 of the flexible shaft 18 can be mounted therein by some suitable means to be driven by the motor 30.

The flexible shaft 18 may be any suitable type of flexible shaft. The flexible shaft 18 has a body portion 37, a connected end 33 and a free end 35. The body portion 37 is biased towards extending in a straight line. The flexible shaft 18 may be a made from metallic wire and preferably has a diameter that is sufficiently small to reduce its visibility to the user 12. Preferably, the cross-sectional thickness of the wire may be in the range of approximately 0.006 inches to approximately 0.008 inches, and more preferably approximately 0.0065 inches to approximately 0.007 inches. In these preferable and more preferable ranges, the wire is generally difficult to see by the user 12. Alternatively, the wire may be thicker so as to support a heavier display object 20. In some embodiments, such as those wherein the wire is thick enough to be easily seen with the naked eye, other means may be employed to hide the presence of the wire. As an example, the lighting near the wire may be controlled to cooperate with the wire to obscure the wire. As another example, elements that reside behind and/or in front of the wire when the system 10 is viewed from a particular viewpoint may be provided with a selected coloration and/or pattern to obscure the wire. In embodiments wherein the vessel 14 is provided, the wall of the vessel 14 both in front of and behind the wire may be colored and/or patterned to obscure the wire. In general, by obscuring the presence of the flexible shaft 18, the display object 20 would appear to be moving in the vessel 14 without being driven by any external power source, enhancing the appearance that the display object 20 is an autonomous winged entity.

It is alternatively possible that in some embodiments the wire need not be obscured at all by any means, and may thus be clearly visible to the viewer.

The wire may have a circular cross-sectional shape. Alternatively, the wire may have a non-circular cross-sectional shape. For example, the wire may have an elliptical cross-sectional shape, or a polygonal cross-sectional shape, such as a triangular cross-sectional shape. The wire may be made from any suitable material, such as type 304V stainless steel.

Preferably, the flexible shaft has a suitable degree of flexibility to permit the display object 20 to move about in the vessel 14 in a random way, thereby augmenting the appearance that the display object 20 is a live autonomous winged entity to the viewer, while having sufficient torsional rigidity to inhibit tangling during operation. The cross-sectional thickness of the flexible shaft 18 impacts on its stiffness. Additionally, the material selected for the flexible shaft 18 impacts on its stiffness.

Preferably, the flexible shaft 18 extends downward into the vessel 14 from above and is of sufficiently long that it is in a curved configuration no matter where the display object 20 is positioned in the vessel 14. By being in a curved configuration, the spring tension in the flexible shaft 18 urges the display object 20 towards the vessel wall 14. As shown in FIG. 2, the flexible shaft 18 is sufficiently long that it contacts the bottom of the vessel wall 21 and bends through an arc of approximately 180 degrees, and urges the display object 20 against a generally vertical portion of the vessel wall 21. By using the spring tension in the flexible shaft 18 to urge the display object 20 against the vessel wall 21 and in particular against a generally vertical portion of the vessel wall 21, the appearance of the display object 20 as an autonomous winged entity is enhanced.

The display object 20 is connected to the flexible shaft 18 at a position that is spaced from the rotational drive system 24. For example, the display object 20 may be connected to the free end 35 of the flexible shaft 18.

The display object 20 may have any suitable structure. For example, the display object 20 may include a plurality of wings 36, including a first wing 38 and a second wing 40 that is generally opposed to the first wing 38. The first and second wings 40 may be made from any suitable material, such as, for example, Mylar™, acetate, polyester film or paper. It is optionally possible for the display object 20 to include more than the two wings 38 and 40. For example, the display object 20 could include a third and a fourth wing (neither of which are shown), for a total of two pairs of wings.

The first and second wings 38 and 40 are preferably rotatable relative to each other. The first wing 38 may be connected to one or more first hinge members 42, through which the flexible shaft 18 passes, and the second wing 40 may be connected to one or more second hinge members 44, through which the flexible shaft 18 passes. Thus, in the embodiment shown in FIG. 3, the flexible shaft 18 itself holds the first and second wings 38 and 40 together.

Some means may be provided to cause relative movement between the first and second wings 38 and 40. For example, one of the wings 38 and 40 may be connected fixedly to the flexible shaft 18, while the other of the wings 38 and 40 may be rotatably connected to the flexible shaft 18. In the particular embodiment shown in FIG. 3, the free end 35 of the flexible shaft 18 is connected to the second wing 40. The first wing 38, however, is not fixedly connected to the flexible shaft 18 and is thus freely rotatable relative to the flexible shaft 18. Thus, the first wing 38 may be referred to as the rotatably attached wing 38, and the second wing 40 may be referred to as the fixedly attached wing 40. It will be understood that it is possible for the second wing 40 to be freely rotatable about the flexible shaft 18 and for the first wing 38 to be fixedly connected to the free end 35 of the flexible shaft 18.

Figure 3:
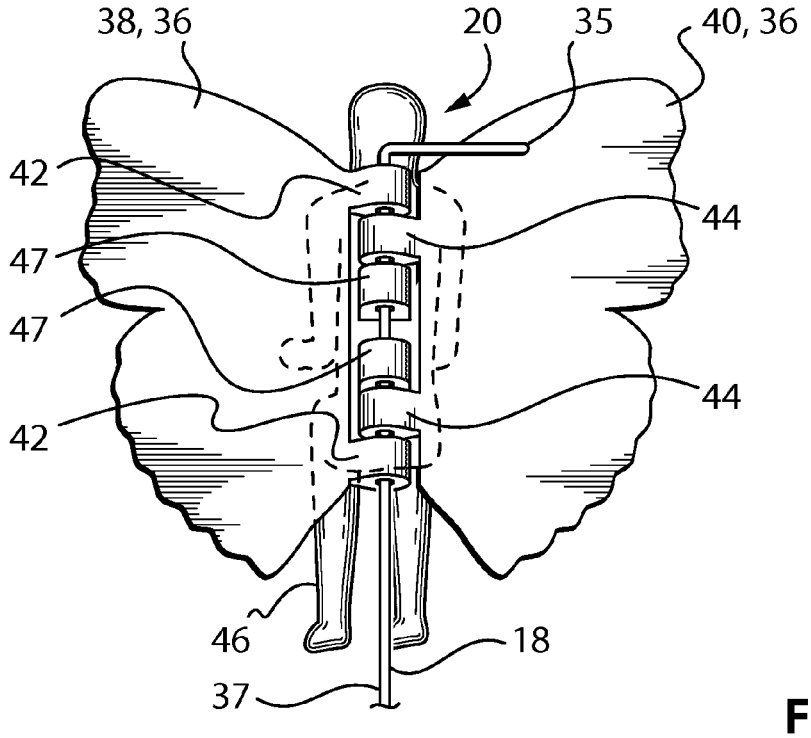
FIG. 3 is a magnified plan view of display object that makes up part of the system shown in FIG. 1.

The display object 20 may further include a body member 46 that is connected to the flexible shaft 18 and that is configured to resemble the body of the entity represented by the display object 20. For example, the body member 46 may be configured to resemble the body of a fairy or the body of a butterfly. The body member 46 may be connected to the flexible shaft 18 in any suitable way. As shown in FIG. 3, the body member 46 may be rotatably connected to the flexible shaft 18 by means of one or more hinge members 47. Thus, in the embodiment shown in FIG. 3, the flexible shaft 18 itself holds the first and second wings 38 and 40 together and also connects the body 46 to the first and second wings 38 and 40. Such a construction simplifies the structure of the overall system 10 by eliminating certain components such as a separate 'hinge pin' (not shown) that could otherwise be used to hold the first and second wings 38 and 40 and body 46 together.

It is alternatively possible for the body member 46 to be directly connected to one or both of the wings 38 and 40.

Figure 4:
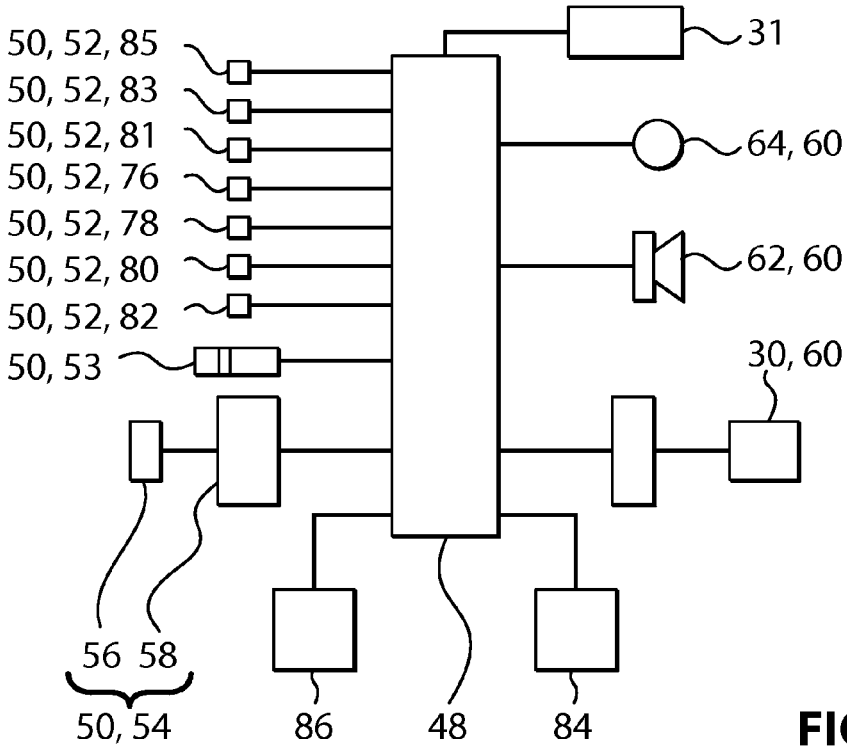
FIG. 4 is a block diagram showing relationship between a plurality of electrical components that are part of the system shown in FIG. 1.

Referring to FIG. 2, the system 10 for representing a winged flying object may optionally include a controller 48. The controller 48 can be used to control several functions, including, for example, the operation of the motor 30. Referring to FIG. 4, the controller 48 may be configured to receive external input from the user 12 (FIG. 1) via one or more input devices 50. The input devices 50 may include, for example, a set of one or more buttons 52, a slide switch 53 and a tap input system 54. The tap input system 54 is configured to receive input from the user 12 in the form of taps by the user 12 on the vessel 14. The tap input system 54 may include a vibration sensor 56 and an amplifier 58.

The controller 48 may be configured to send signals to one or more output devices 60, such as the motor 30, an audio output device 62 such as a speaker, and a light 64, which may be, for example, an LED. The operation of the controller 48 and associated input and output devices 50 and 60 is described further below.

The controller 48 may be programmed with a plurality of actions 65 (see FIG. 5). For example, exemplary actions 65 may include: FLY, FLAP, FLUTTER, REST, FEED, LOVE, SNOOZE, DANCE and QUESTION, which are shown at 65*a*, 65*b*, 65*c*, 65*d*, 65*e*, 65*f*, 65*g*, 65*h* and 65*i* respectively. FIG. 5 is a list of the exemplary actions 65, along with an indication of whether there are one or more types of variants. For example, for the FLY action 65*a*, there are two variants which are discussed further below.

The controller 48 may control several motor parameters 66 (FIGS. 6*a*, 6*b* and 6*c*) in order to carry out the different actions 65. Exemplary parameters 66 are shown at 66*a*, 66*b* and 66*c* in FIGS. 6*a*, 6*b* and 6*c* respectively, along with exemplary values for them. Parameter 66*a* (FIG. 6*a*) may be, for example, the angle through which the motor 30 rotates during a single motor movement (also referred to as a rep) of an action 65. For example, for a FLAP action 65*b*, the motor 30 rotates through 32 half-steps (which for the exemplary bipolar stepper motor 30 described above corresponds to 288 degrees of rotation) for each rep. Another parameter 66*b* (FIG. 6*b*) is the number of reps to be carried out by the motor 30 to complete an action. For example, a FLAP action would involve the fixedly attached wing 40 reciprocating back and forth from one to five times. Another parameter 66*c* (FIG. 6*c*) is the speed of rotation of the motor 30.

As shown in FIGS. 6*a*, 6*b* and 6*c*, the values for one or more of the parameters 66 can vary within a range. For example, the speed of the motor 30 (parameter 66*c* shown in FIG. 6*c*) during a FLAP action 65*b* can be anywhere from a first speed (which is given a value of 3 in FIG. 6*c*) and a second speed (which is given a value of 35 in FIG. 6*c*). In the particular embodiment shown in FIG. 6*c*, the speed values shown may refer to a period of delay between each of the polarity/phase changes of the motor 30. A smaller value (eg. a value of 3) corresponds to a shorter delay between polarity/phase changes and a greater value (eg. a value of 35) corresponds to a longer delay between polarity/phase changes. Thus, in this exemplary embodiment, a speed of 3 is faster than a speed of 35.

One or more of the parameters 66 selected for a particular action 65 (FIG. 5) may be selected randomly. For example, with respect to a FLY action the motor speed parameter 66*c* and the number of reps that make up an action (parameter 66*b*) may be randomly selected values that fall within the selected acceptable ranges of motor speeds and number of reps.

Thus, a first FLY action 65*a* may take place for a first number of reps and at a first motor speed and a subsequent FLY action 65*a* may take place for a second number of reps at a second motor speed. The appearance of randomness in the actions 65 being carried out further enhances the appearance that the display object 20 is an autonomous winged entity.

Randomly selected values may be selected in any suitable way. For example, they may be truly randomly selected (using a random number routine) or may alternatively be selected from a table of random numbers.

Each of the actions 65 is described in further detail below. A FLY action 65*a* may include two variants. In the first variant, the motor 30 is rotated through a selected number of movements at a selected speed. In the second variant, the motor 30 is rotated in one direction through a first selected number of movements at a first selected speed, and is then rotated in the opposite direction through a second selected number of movements at a second selected speed.

For a FLY action, the specific variant, the number of reps and the motor speed may all be randomly selected.

During a FLY action 65*a*, the fixedly connected wing 40 pushes the rotatably connected wing 38 to rotate with it. The rotation of the wings 38 and 40 pushes the display object 20 away from the vessel wall 21 and causes the display object 20 to move around in the vessel 14. Spring tension in the flexible shaft 18 and/or the action of the wings 38 and 40 rotating and colliding with the vessel wall 21 can cause the display object 20 to move in an apparently random way in the vessel 14, thereby enhancing the appearance that the display object 20 is an autonomous winged entity. In general, however, rotation of the wings 38 and 40 in one direction will drive the display object 20 to move in a particular direction around the interior 22 of the vessel 14. When the flexible shaft 18 stops rotating, the fixedly connected wing 40 also stops rotating. The spring tension in the flexible shaft 18 causes the display object 20 to again engage the vessel wall 21, appearing to have 'landed'.

By providing the second variant of the FLY action 65*a*, the display object 20 may move in a first direction around the interior 22 and then move in the opposite direction around the interior 22 in relatively quick succession, which mimics the movements that have been observed in some entities, such as butterflies.

A FLAP action involves reciprocation of the fixedly connected wing 40 back and forth a selected number of times. The FLAP action may include several variants. For example, in a first variant, the fixedly connected wing 40 moves back and forth at the same speed. In a second variant the fixedly connected wing 40 moves in one direction at a first speed, and in the other direction at a second speed. In a third variant, the motor speed for the wing movement in the both directions may be randomly selected values (which may differ for wing movement in each direction). In a fourth variant, the motor speed increases progressively throughout the action. For example, the variant may progress as follows: the motor 30 rotates initially in a first direction at a first speed, then rotates in the opposite direction (to complete the first rep) at an incrementally higher speed, then rotates in the first direction again at a yet higher speed, and so on until the action is completed. In a fifth variant, the motor speed decreases progressively throughout the action.

Referring to FIG. 2, as the motor 30 rotates, the flexible shaft 18 causes the fixedly attached wing 40 to rotate by some amount, which may or may not be the same amount that the motor 30 rotates depending on the stiffness of the flexible shaft 18. During the reciprocation of the fixedly attached wing 40, the rotatably attached wing 38 may remain substantially stationary. The fixedly attached wing 40 may approach or contact the rotatably attached wing 38 when moving in one direction and may separate from the rotatably attached wing 38 when moving in the other direction, thereby appearing to flap.

It will be noted that, during a FLAP action 65*b*, one or both of the wings 38 and 40 may move, and the body 46 of the display object 20 may move somewhat, but overall, the display object 20 remains stationary. By contrast, during a FLY action 65*a*, the entire display object 20 moves about in the vessel 14. Thus, the system 10 may be capable of providing movement in elements of the display object 20 while keeping the overall display object stationary in the vessel 14, and may be also capable of providing movement to the entire display object 20 to move the display object 20 about.

The FLUTTER action 65*c* may be similar to the FLAP action 65*b*, and may involve reciprocation of the motor 30 (and consequently the fixedly attached wing 40), however the FLUTTER action 65*c* occurs at a high motor speed. There may be two variants of the FLUTTER action 65*c*. In the first variant, the angle swept in one rep (parameter 66*a*) may be 16 full steps of the motor 30 (ie. an angular distance of 288 degrees, similar to a FLAP action 65*b*. In the second variant, the angle swept in one rep may be 10 full motor steps, ie. 180 degrees.

The REST action 65*d* involves powering down of the motor 30 for a selected period of time. The amount of time may vary and may be selected randomly.

The FEED action 65*e* is used as part of an optional feature of the system 10, wherein the display object 20 is treated by the user 12 (FIG. 2) like a virtual pet. For example, when the user 12 presses a FEED button, shown at 82, the controller 48 carries out a FEED action 65*e*. The FEED action 65*e* is intended to symbolize the display object 20 eating something or nibbling something, and may involve the motor 30 reciprocating back and forth over a selected angular range, which may be small, (eg. 6 half-steps or 54 degrees). In an exemplary embodiment, the FEED action 65*e* may be carried out when the button 82 (FIG. 4) is depressed and is stopped when the button 82 is not depressed. The motor 30 speed involved in a FEED action 65*e* may range from a speed of 10 which is relatively fast, to 30, which is relatively slow.

The LOVE action 65*f* is also used as part of the treatment of the display object 20 as a virtual pet and may also take place only when a selected button (shown at 80) is depressed. The LOVE action 65*f* may be similar to the FEED action 65*e*, (eg. reciprocation over a short angular range) except that it involves a high motor speed (eg. a motor speed value of 2-4).

The SNOOZE action 65*g* may also be part of the treatment of the display object 20 as a virtual pet and may also take place only when a selected button (shown at 81) is depressed. The SNOOZE action 65*g* may be similar to the FLAP action 65*b*, except that the SNOOZE action 65*g* may take place at very slow speed. The speed of the motor 30 may be sufficiently slow to permit the user 12 to see the motor 30 step through its angular range when performing the action 65*g*. This slow movement of the display object 20 and any associated sound may be suggestive that the display object 20 is snoring. It is optionally possible that upon depression of the button 81, the controller 48 would progressively ramp down the speed of the motor 30 as the SNOOZE action 65*g* progresses to make it appear that the display object 20 gradually falls asleep, instead of responding immediately to the press of the button 81 with slow wing movement. It is also optionally possible for the controller 48 to ramp up the speed of the motor 30 once the button 81 is no longer depressed, to make it appear that the display object 20 wakes up gradually from a sleep state, instead of immediately making the display object 20 active.

The DANCE action 65*h* may also take place only when a selected button (shown at 83) is depressed. The DANCE action 65*h* may be similar to a FLAP action 65*b* but with each movement of the fixedly connected wing 40 sweeping through two full revolutions before changing direction. As a result, the entire display object 20 flips over back and forth as the wing 40 rotates back and forth. This flipping over back and forth resembles a dancing action.

It is optionally possible for the controller 48 (FIG. 4) to play music through the speaker 62 when the button 83 is depressed and to synchronize the movements in the DANCE action 65*h* to match the beat of the music. Synchronizing the music, which is stored digitally, and the movement of the motor 30 is facilitated in embodiments wherein the motor is a stepper motor.

It is also optionally possible to introduce other types of movement to be synchronized with music as part of a DANCE action 65*h*. For example, the controller 48 may intersperse periods of reciprocating movement of the motor 30 with a brief period of rotation of the motor 30 through multiple revolutions in one direction, (similar to a FLY action 65*a*), or with a brief period that is similar to a FLUTTER action 65*c*, as part of a DANCE action 65*h*. It is also optionally possible for the movement of the motor 30 to be synchronized with other sounds from the speaker 62 and not just music.

Synchronizing music and/or other sounds may be done with several other actions 65 also, such as the FLAP action 65*b*, the FLUTTER action 65*c*, the FEED action 65*e*, the LOVE action 65*f*, the SNOOZE action 65*g* and the QUESTION action 65*i*. Synchronized movement and sound may be used as a form of communication from the display object 20 to the user 12. Selected combinations of sounds and movements can be provided with selected meanings. The meanings can be listed in a manual that would be provided to the user 12 with the purchase of the system 10.

In the QUESTION action 65*i*, the user 12 (FIG. 2) presses a button, shown at 85 after posing a question to the display object 20. The controller 48 selects one of three possible variants with which to respond. The selection of which variant to respond with may be random since the controller 48 is not contemplated in some embodiments to be capable of interpreting human speech. The first variant may itself comprise three actions 65 in succession: a REST action 65*d* which lasts for three seconds, a FLY action 65*a* in which the fixedly connected wing 40 rotates in a first selected direction to drive the display object 20 around the interior 22 of the vessel 14 in a first selected direction (eg. clockwise when viewed from above), followed by another three-second REST action 65*d*. Preferably, the display object 20 would make approximately two complete loops around the vessel interior 22 in the first variant. This first variant may correspond to an answer of "YES". The motor speed would be selected so that the display object 20 would travel sufficiently slowly as to appear to be moving deliberately.

The second variant may comprise three actions 65 in succession: a first three-second REST action 65*d*, a FLY action 65*a* in which the fixedly connected wing 40 rotates in a second selected direction to drive the display object 20 around the interior 22 of the vessel 14 in a second selected direction (eg. counter-clockwise when viewed from above), followed by another three-second REST action 65*d*. This second variant may correspond to an answer of "NO". Preferably, the display object 20 would make approximately two complete loops around the vessel interior 22 in the second variant.

The third variant may involve a first three-second REST action 65*d*, followed by a succession of three FLY actions 65*a*, wherein the display object 20 flies in a first direction (eg. clockwise) approximately half-way around the vessel interior 22, then flies in a second direction (eg. counter-clockwise) approximately half-way around the vessel interior 22, then flies in the first direction again approximately half-way around the interior 22. This third variant may correspond to an answer of "MAYBE".

The FLAP action 65*b* (FIG. 5) and some of the other actions 65, such as the FLUTTER action 65*c* particularly enhance the appearance of the display object 20 (FIG. 2) as a butterfly or the like, since these types of actions are carried out by some butterflies while resting on a surface.

It will be noted that for each of the actions 65 described above, many of the parameters 66 may have an acceptable range of values associated therewith. For any of those parameters 66, the values may be randomly selected numbers, as described above. It is optionally possible for the controller 48 to change the acceptable range of values for the one or more of the parameters 66 associated with any particular action 65. For example, the controller 48 may, over time, adjust the acceptable ranges of values for selected parameters 66 for selected actions 65 so that the display object 20 becomes progressively less active over time. For example, the range of values relating to the length of a REST action 65*d* may gradually increase over time. For example, initially, the length of a REST action 65*d* may be randomly selected from a range of 1 to 6 seconds. After 2 minutes of use of the system 10, the range may be adjusted so that the length of a REST action 65*d* may be randomly selected from a range of 2 to 7 seconds. After another two minutes, the range may be adjusted again, to between 3 and 8 seconds. It is also possible for the controller 48 to adjust the acceptable ranges of selected parameters 66 to make the display object 20 progressively more active over time. For example, the controller 48 may be programmed to gradually increase the frequency of occurrences of FLY actions 65*a* over time. Progressively changing the behaviour of the display object 20 in some way as described herein can further increase the realism of the display object 20 to the user 12 (FIG. 2).

Separately from randomly selecting values of parameters 66, however, the sequence of actions 65 that are carried out by the controller 48 may be selected randomly. For example, the controller 48 may select randomly between carrying out a FLY action 65*a*, a FLAP action 65*b*, a FLUTTER action 65*c* and a REST action 65*d*. In this way, the behaviour of the display object 20 is made to appear less predictable and therefore more autonomous. It will be noted, however, that even if the same action 65 is selected to be carried out two or more times in succession, each carrying out of the action 65 can vary due to the random selection of the parameters 66 associated therewith.

Referring to FIG. 3, during movement of the fixedly connected wing 40, movement may be generated in the rotatably attached wing 38. The extent to which this occurs depends at least in part on how the display object 20 is positioned on the vessel wall 21. For example, positional variables of the display object 20 that can impact on the movement generated in the rotatably attached wing 38 include whether the fixedly attached wing 40 is vertically higher than or lower than the rotatably attached wing 38 when the display object 20 has landed at an angle or whether the display object is in an substantially upright position with both wings 38 and 40 at the same level. The rotatably connected wing 38 can be made to move by some amount in the same direction as the fixedly connected wing 38 in some circumstances if, for example, there is sufficient frictional engagement between the first and second hinge members 42 and 44. It is optionally possible for the first and second hinge members 42 and 44 to be abraded along their mating surfaces so as to increase the frictional forces between them. Alternatively small teeth could be molded or otherwise provided on their mating surfaces to increase the frictional forces between them.

Additionally, the rotatably attached wing 38 may be made to move in the same direction as the fixedly attached wing 40 as a result of being drawn in to the low pressure zone that may be created behind the fixedly attached wing 40 during movement thereof. Alternatively, the frictional force between them may be provided by virtue of material selection. For example, the hinge members may be may made from a rubbery material that has a high coefficient of friction when mated to a similar material.

It is also optionally possible for the fixedly attached wing 40 and the rotatably attached wing 38 to be made to appear to counter-rotate relative to each other. For example, during a FLAP action 65*b* or a FLUTTER action 65*c*, as the fixedly attached wing 40 moves it creates a negative pressure zone behind it, which can draw the rotatably attached wing 38 towards it, as noted above. However, if the fixedly attached wing 40 is moving at a relatively high speed, as may be the case in a fast FLAP action 65*b* or in a FLUTTER action 65*c*, it may complete its travel in a first direction and be returning in the opposite direction, while momentum continues to carry the rotatably attached wing 38 in the first direction. As a result, at certain moments, the fixedly attached wing 40 and the rotatably attached wing 38 may counter-rotate relative to each other.

Thus, movement may be generated in the rotatably attached wing 38 that is at least to some degree independent of the movement of the movement of the fixedly connected wing 40 and that is varied, which further enhances the appearance of the display object 20 as an autonomous winged entity, without the additional expense associated with positively driving the rotatably connected wing 38.

The direction of rotation of the motor 30 is preferably alternated with each subsequent action being executed, thereby reducing the likelihood of the flexible shaft 18 being over-rotated in one direction and tangling. For example, a first action to be carried out may be, for example, a FLY action 65*a*. The FLY action 65*a* may involve rotation of the motor 30 by some selected amount in one particular direction, such as, a clockwise direction. The subsequent action to be carried out may be, for example, a FLAP action 65*b*, which may involve a reciprocation of the wings 38 and 40 back and forth for a selected number of cycles. The controller 48 may be programmed to begin the first movement of the FLAP action 65*b* by rotating the motor 30 in the counter-clockwise direction. In this hypothetical example, the motor 30 would reciprocate by some selected number of cycles and would end with a movement in the clockwise direction. The next action to be carried out may, for example, be another FLY action 65*a*. Because the last movement of the motor 30 was in the clockwise direction, this second FLY action 65*a* would be carried out by rotating the motor in the counter-clockwise direction. Thus, prior to the carrying out of any action (except a REST action 65*c* which does not involve rotation of the motor 30, and except a "YES"-type QUESTION action or a "NO"-type QUESTION action), the direction of rotation of the motor 30 may always reverse from the last movement carried out.

Referring to FIG. 4, the buttons 52 may include a music button 76 for selecting whether music or any other sounds are to be played from the audio output device 62, a sleep button 78 for alternately bringing the system 10 into and out of a sleep mode and a light button 80 for alternately turning on and off the light 64. Other buttons 52 may include the 'love' button 80, the 'feed' button 82, the 'snooze' button 81, the 'dance' button 83 and the 'question' button 85.

Referring to FIG. 4, the slide switch 53 may be used to control the operating mode of the system 10. The modes that may be selected may include: ON-with no sound, ON-with sound, TRY-ME (a demonstration mode tailored for use while the item is on display in a store), and OFF. It will be understood that selecting between ON-with sound and ON-without sound may be different than selecting whether music is played through the audio output device 62. For example, there may be sounds that are outputted through the audio output device 62 during use of the system 10, which are not music. The slide switch 53 may have any suitable form, if one is provided. For example, the slide switch 53 could be a simple thumb- or finger-operated switch with a plurality of positions. Alternatively, the lid 28 could act as a slide switch and may be rotatable between a plurality of detented positions, each position corresponding to a particular mode.

The light 64 may be any suitable type of light, such as an LED, as noted above. The light 64 may simply be used to illuminate the interior 22 of the vessel 14. Additionally or alternatively, the light 64 may optionally cooperate with the colours on the display object 20 to create a particular effect. For example, the light 64 may emit sufficient visible light to illuminate the interior 22 of the vessel 14, but may also emit a selected amount of ultra-violet light, and the display object 20 may be provided with pigments that glow when exposed to ultraviolet light. Additionally, the light 64 may be controlled by the controller 48 so as to be synchronized with the movement of the display object 20. For example, the light 64 may flash, flicker, dim and/or brighten in coordination with movements taking place by the display object 20.

Referring to FIG. 2, the tap input system 54 receives input from the user 12 in the form of taps by the user 12 on the vessel 14, and converts them to signals which are sent to the controller 48. The controller 48 may be programmed to respond differently depending on the number of taps made by the user 12. For example, if the user 12 taps once on the vessel 14, the controller 48 may be programmed to immediately carry out a FLY action 65*a* (FIG. 5); if the user 12 (FIG. 2) taps twice on the vessel 14 (within some specified period of time between taps), the controller 48 may be programmed to immediately carry out a FLAP action 65*b* (FIG. 5); if the user 12 (FIG. 2) taps three times on the vessel within some specified period of time between taps, the controller 48 may be programmed to immediately carry out a FLUTTER action 65*d* (FIG. 5). By configuring the controller 48 (FIG. 2) to interrupt whatever action 65 (FIG. 5) is currently being carried out upon receiving input through the tap input system 54 (FIG. 2), the appearance of communication between the user 12 and the display object 20 is created.

After an action that resulted from a tap input by the user 12 is carried out, the controller 48 may carry out a REST action 65*c* (FIG. 5) for a brief period, such as 1 second, before carrying out some other activity, such as whatever action was interrupted by the tap input. This REST action 65*c* gives the user 12 (FIG. 2) time to enter another tap input on the vessel 14, which will instruct the controller 48 to carry out another user-selected action 65 (FIG. 5). Thus, the appearance of communication between the user 12 (FIG. 2) and the display 20 is further enhanced.

The use of a tap input system 54 in particular over other forms of input system, such as buttons, further enhances the appearance of communication by the user 12 with an autonomous winged entity such as a butterfly, since tapping on the vessel 14 would be a typical method by which a user 12 would attempt to communicate with such an entity in the vessel 14. It is, however, alternatively possible for other types of input system to be used instead of the tap input system 54. For example, a proximity sensor, a photo sensor and/or a touch sensor could be used as ways of permitting interaction between the user 12 and the display object 20.

During certain actions 65, such as a FLY action 65*a* and a FLUTTER action 65*c*, it may be preferable to disable the tap input system 54 because during these actions 65, there may be significant amounts of knocking against the vessel wall 21 from the display object 20 itself, which would potentially trip the vibration sensor 56. Additionally, the tap input system 54 may be disabled during carrying out of certain other actions 65, such as those which are button activated, such as the FEED, LOVE, SNOOZE, DANCE and QUESTION actions 65*e*, 65*f*, 65*g*, 65*h* and 65*i*.

Aside from reacting to tap inputs from the user 12, the controller 48 may normally operate the motor 30 according to a sequence of actions 65 (FIG. 5) stored in memory, shown at 84 in FIG. 4 or according to a random sequence of actions, as described above. The slide switch 53 (FIG. 4) is provided to control which operating mode the system 10 is in. For example, the system 10 may carry out a different sequence of actions 65 (FIG. 5) when in the TRY-ME mode than it does when in the ON-with sound mode.

Referring to FIG. 2, the system 10 may optionally be provided with a tilt sensor 86 that is configured to determine whether the vessel 14 is tilted at too great an angle. The angle at which the vessel 14 is tilted impacts the risk of the flexible shaft 18 tangling during use. The tilt sensor 86 may be any suitable kind of tilt sensor. The tilt sensor 86 may act as another input device 50 that sends a signal to the controller 48. The controller 48 may be configured to respond to tripping of the tilt sensor 86 by cutting off power to the motor 30.

Figure 7:
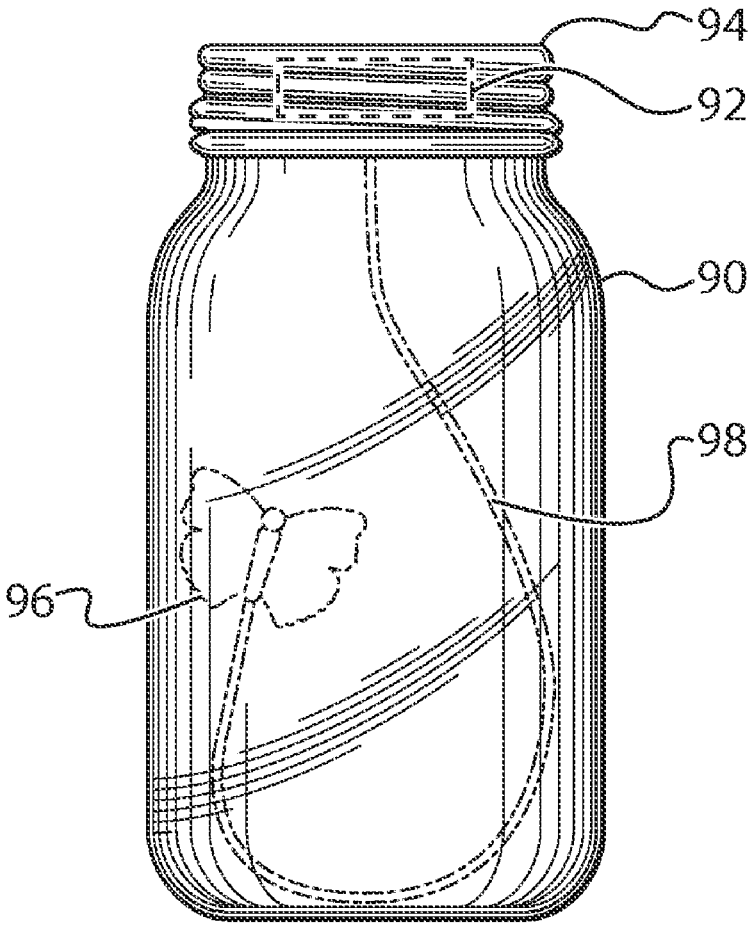
FIG. 7 is an elevation view of an alternative vessel and an alternative display object that can be used with the system shown in FIG. 1.

Reference is made to FIG. 7, which shows an alternative vessel 90 that can be used with the system 10 instead of the vessel 14. The vessel 90 may differ from the vessel 14 in several respects. For example, the vessel 90 may have a square shaped interior cross-section when viewed from above. The vessel 90 may resemble a typical glass canning jar. In the embodiment shown in FIG. 7, the entire rotational drive system, shown at 92, is contained in the vessel lid, shown at 94. Additionally, all the sensors, the battery and the controller are all contained in the vessel lid 94 also. Preferably input means, such as a slide switch would be integrated into the lid 94 in a discrete way. For example, the lid could be rotatable between a plurality of detented positions each serving a selected purpose as described above in relation to the lid 28 (FIG. 2). As a result, the presence of the rotational drive system 92 is further obscured since the user may assume that the lid is a typical lid on a typical glass canning jar.

Also shown in FIG. 7 is an alternative display object 96. The display object 96 is a butterfly, which may be connected to the flexible shaft 98 in any suitable way.

It has been shown in FIG. 3 for the second wing 40 to be fixedly attached to the flexible shaft 18. It will be understood that it is alternatively possible for the first wing 38 to be the fixedly attached wing and for the second wing 40 to be the rotatably attached wing.

The rotational drive system 16 shown in FIG. 2 includes the motor 30 that is battery driven and that is controlled by the controller 48. It is optionally possible for the rotational drive system 16 to also include some means for recharging the battery pack 31, such as, for example, a solar energy collection system (not shown).

It is alternatively possible for the rotational drive system 16 to not be driven by an electric motor at all, but instead to be driven by some mechanical alternative, such as a spring-driven rotary device (not shown). The spring-driven rotary device uses a spring to store and release energy, and could be accompanied by a suitable mechanism by which the user 12 can store energy in the spring, eg. by means of a drawstring, a wind-up key or the like. The controller 48 could still be used in this alternative embodiment for receiving input from the user 12 controlling devices such as a speaker 62 and an LED 64, and could further be used to control the release of energy from the spring by some means, such as by operating a solenoid to obstruct or permit the spring's movement.

As another alternative, the motor 30 may be a DC motor that is not a stepper motor. In such an embodiment, the actions carried out by the motor 30 could be effected using, for example, multiple gear sets that are positionally controlled using one or more solenoids, a gear-based transmission, a belt drive, or by any other suitable means.

The first and second wings 38 and 40 shown in FIG. 3 are connected to each other in such a way as to be rotatable relative to each other about a common axis (the axis of the flexible shaft 18). It is alternatively possible for the first and second wings 38 and 40 to each be rotatably connected to a body member for rotation about individual axes relative to the body member. Accordingly the first and second wings 38 40 need not be rotatable about a common axis.

The first and second wings 38 and 40 shown in FIG. 3 are distinct members that are physically separate from each other. It is alternatively possible for the first and second wings 38 and 40 to be integrally connected to each other while still being rotatable relative to each other. For example, the first and second wings 38 and 40 could be formed from a single piece of a suitable material, eg. a polymeric material. One or more bends in the material could act as a living hinge. The piece of material could be joined to the flexible shaft 18 by some suitable means such as glue at a suitable location between the wings 38 and 40, and the free end 35 of the flexible shaft 18 could still be connected to one of the wings 38 and 40 such that that wing 38 or 40 is fixedly connected to the flexible shaft 18.

The system 10 shown in FIGS. 1 and 2 includes a vessel 14 in which the display object 20 moves around. The vessel wall 21 constitutes a landing surface for the display object 20. It is alternatively possible to provide a system (not shown) in which a vessel is not provided. Such a system could nonetheless include an upper member on which a motor or some other rotational drive system is mounted, and could have a flexible shaft that extends downwardly from the motor. The display object could be connected to the flexible shaft in a similar way to the display object 20 on the flexible shaft 18. The system preferably includes one or more landing surfaces for the display object to land on (eg. when the motor is not rotating). The system is preferably configured so that the flexible shaft is kept out of its naturally straight orientation into a curved (eg. a U-shaped) orientation) by some means, so that it urges the display object towards the one or more landing surfaces.

In another embodiment that is not shown, the system 10 may simultaneously display more than one display object 20. For example, the system 10 may include a vessel, a rotational drive system including a motor and two flexible shafts each having a display object 20 at the free end. The motor may be connectable by some transmission/clutch means to one or to the other flexible shaft. Optionally the motor could be made strong enough to drive both flexible shafts simultaneously. Alternatively, the system could include two separate motors each connected to one of the flexible shafts, but both optionally being controlled by a common controller. Depending on, among other things, the likelihood of entanglement between the two or more display objects, it is optionally possible in such an embodiment to have the one or more barriers in the vessel to prevent the display objects from entangling.

While the above description constitutes a plurality of embodiments of the present invention, it will be appreciated that the present invention is susceptible to further modification and change without departing from the fair meaning of the accompanying claims.

The invention claimed is:

1. A system for representing an autonomous winged entity, comprising:

a vessel having a vessel wall that defines an interior, wherein the interior is viewable from outside the vessel;

a rotational drive system;

a flexible shaft connected to the rotational drive system for rotation by the rotational drive system; and a display object positioned in the interior of the vessel and connected to the flexible shaft at a position that is spaced from the rotational drive system, wherein the display object has a plurality of wings, including a first wing and a second wing, and wherein rotation of the flexible shaft causes the display object to move within the vessel, wherein one of the first and second wings is fixedly attached to the flexible shaft for rotation therewith, and the other of the first and second wings is generally opposed to the first wing and is rotatably connected to the flexible shaft.

2. A system for representing an autonomous winged entity as claimed in claim 1, further comprising a controller, wherein the rotational drive system includes a motor that is controllable by the controller to reciprocate to generate a reciprocating motion in at least one of the wings.

3. A system for representing an autonomous winged entity as claimed in claim 1, further comprising a controller, wherein the rotational drive system includes a motor, wherein the controller is configured to cause the motor to carry out a plurality of actions, wherein each action is made up of one or more movements.

4. A system for representing an autonomous winged entity as claimed in claim 3, wherein the controller is configured to select the direction of movement of the motor in an upcoming action based on the direction of movement of the motor in the immediately preceding action.

5. A system for representing an autonomous winged entity as claimed in claim 3, wherein the plurality of actions includes a first action in which the motor is rotated in one direction for a selected number of revolutions and a second action wherein the motor is reciprocated a selected number of times over a selected angular distance.

6. A system for representing an autonomous winged entity as claimed in claim 3, wherein during at least one action at least one of the wings pushes the display object substantially away from contact with the vessel wall and wherein the flexible shaft has sufficient spring tension therein to urge the display object into contact with the vessel.

7. A system for representing an autonomous winged entity as claimed in claim 6, wherein the vessel has a top and wherein the flexible shaft extends downward from a position proximate the top of the vessel, and wherein the flexible shaft is biased towards a rest configuration that is straight and wherein the flexible shaft is in a curved configuration in the vessel to generate spring tension in the flexible shaft, wherein the flexible shaft urges the display object against the vessel wall as a result of the spring tension, wherein the flexible shaft is sufficiently flexible to permit the display object to leave the vessel wall during at least one of the actions.

8. A system for representing an autonomous winged entity as claimed in claim 3, wherein throughout at least one action the display object remains in contact with the vessel wall as a result of spring tension in the flexible shaft.

9. A system for representing an autonomous winged entity as claimed in claim 8, wherein the at least one action includes reciprocation of the motor a selected number of times over a selected angular distance.

10. A system for representing an autonomous winged entity as claimed in claim 8, wherein the motor is controllable by the controller to reciprocate to generate a reciprocating motion in at least one of the wings, wherein the at least one action includes reciprocation of the motor a selected number of times over a selected angular distance at a selected angular speed.

11. A system for representing an autonomous winged entity as claimed in claim 3, wherein the plurality of actions includes a first action in which the motor is rotated in one direction for a selected number of revolutions and a second action wherein the motor is reciprocated a selected number of times over a selected angular distance at a selected angular speed.

12. A system for representing an autonomous winged entity as claimed in claim 3, wherein throughout at least one action the flexible shaft is rotated and the display object remains stationary against the vessel wall as a result of spring tension in the flexible shaft.

13. A system for representing an autonomous winged entity as claimed in claim 3, wherein throughout at least one action the display object remains motionless and in contact with the vessel wall as a result of spring tension in the flexible shaft.

14. A system for representing an autonomous winged entity as claimed in claim 1, wherein the display object is configured to have the appearance of a fairy.

15. A system for representing an autonomous winged entity as claimed in claim 1, wherein the display object is configured to have the appearance of a butterfly.

16. A system for representing an autonomous winged entity as claimed in claim 1, wherein the rotational drive system includes a motor and wherein the system for representing an autonomous winged entity further comprises a controller for controlling rotation of the motor, and an input system connected to the controller and permitting a user to control the controller.

17. A system for representing an autonomous winged entity as claimed in claim 16, wherein the input system includes a tap input system configured to sense tapping on the vessel.

18. A system for representing an autonomous winged entity as claimed in claim 1, wherein the vessel includes a drive system enclosure that defines a drive system enclosure cavity, wherein the rotational drive system includes a motor, wherein the motor is positioned in the drive system enclosure cavity so as to be obscured from view by a user.

19. A system for representing an autonomous winged entity as claimed in claim 18, wherein the drive system enclosure is positioned in a lid for the vessel.

20. A system for representing an autonomous winged entity as claimed in claim 1, wherein the flexible shaft is made from wire having a cross-sectional thickness that is less than about 0.008 inches.

21. A system for representing an autonomous winged entity as claimed in claim 1, wherein the vessel has a top and wherein the flexible shaft extends downward from a position proximate the top of the vessel.

22. A system for representing an autonomous winged entity as claimed in claim 21, wherein the flexible shaft is biased towards a rest configuration that is straight and wherein the flexible shaft is in a curved configuration in the vessel to generate spring tension in the flexible shaft, wherein the flexible shaft urges the display object against the vessel wall as a result of the spring tension.

23. A system for representing an autonomous winged entity as claimed in claim 1, wherein the first wing is connected to at least one first hinge member and the second wing is connected to at least one second hinge member and the flexible shaft passes through the at least one first hinge member and the at least one second hinge member.

24. A system for representing an autonomous winged entity as claimed in claim 23, wherein the display object further comprises a body member wherein the body member is connected to at least one third hinge member, and wherein the flexible shaft passes through the at least one third hinge member.

25. A system for representing an autonomous winged entity, comprising:

a vessel having a vessel wall that defines an interior, wherein the interior is viewable from outside the vessel;

a rotational drive system;

a flexible shaft connected to the rotational drive system for rotation by the rotational drive system; and a display object positioned in the interior of the vessel and connected to the flexible shaft at a position that is spaced from the rotational drive system, wherein the display object has a plurality of wings, including a first wing and a second wing, and wherein rotation of the flexible shaft causes the display object to move within the vessel; and a controller, wherein the rotational drive system includes a motor, wherein the controller is configured to cause the motor to carry out a plurality of actions, wherein each action is made up of one or more movements, wherein during at least one action at least one of the wings pushes the display object substantially away from contact with the vessel wall and wherein the flexible shaft has sufficient spring tension therein to urge the display object into contact with the vessel.

26. A system for representing an autonomous winged entity as claimed in claim 25, wherein the vessel has a top and wherein the flexible shaft extends downward from a position proximate the top of the vessel.

27. A system for representing an autonomous winged entity as claimed in claim 25, wherein the first wing is connected to at least one first hinge member and the second wing is connected to at least one second hinge member and the flexible shaft passes through the at least one first hinge member and the at least one second hinge member.

28. A system for representing an autonomous winged entity as claimed in claim 25, wherein throughout at least one action the flexible shaft is rotated and the display object remains stationary against the vessel wall as a result of spring tension in the flexible shaft.

29. A system for representing an autonomous winged entity as claimed in claim 25, wherein throughout at least one action the display object remains motionless and in contact with the vessel wall as a result of spring tension in the flexible shaft.

30. A system for representing an autonomous winged entity, comprising:

a vessel having a vessel wall that defines an interior, wherein the interior is viewable from outside the vessel;

a rotational drive system;

a flexible shaft connected to the rotational drive system for rotation by the rotational drive system; and a display object positioned in the interior of the vessel and connected to the flexible shaft at a position that is spaced from the rotational drive system, wherein the display object has a plurality of wings, including a first wing and a second wing, and wherein rotation of the flexible shaft causes the display object to move within the vessel, wherein the vessel has a top and wherein the flexible shaft extends downward from a position proximate the top of the vessel.

31. A system for representing an autonomous winged entity as claimed in claim 30, further comprising a controller, wherein the rotational drive system includes a motor, wherein the controller is configured to cause the motor to carry out a plurality of actions, wherein each action is made up of one or more movements.

32. A system for representing an autonomous winged entity as claimed in claim 30, wherein the vessel includes a drive system enclosure that defines a drive system enclosure cavity, wherein the rotational drive system includes a motor, wherein the motor is positioned in the drive system enclosure cavity so as to be obscured from view by a user, wherein the drive system enclosure is positioned in a lid for the vessel.

33. A system for representing an autonomous winged entity, comprising:

a vessel having a vessel wall that defines an interior, wherein the interior is viewable from outside the vessel;

a rotational drive system;

a flexible shaft connected to the rotational drive system for rotation by the rotational drive system; and a display object positioned in the interior of the vessel and connected to the flexible shaft at a position that is spaced from the rotational drive system, wherein the display object has a plurality of wings, including a first wing and a second wing, and wherein rotation of the flexible shaft causes the display object to move within the vessel, wherein the first wing is connected to at least one first hinge member and the second wing is connected to at least one second hinge member and the flexible shaft passes through the at least one first hinge member and the at least one second hinge member.

34. A system for representing an autonomous winged entity as claimed in 33, wherein the display object further comprises a body member wherein the body member is connected to at least one third hinge member, and wherein the flexible shaft passes through the at least one third hinge member.

35. A system for representing an autonomous winged entity as claimed in claim 33, further comprising a controller, wherein the rotational drive system includes a motor, wherein the controller is configured to cause the motor to carry out a plurality of actions, wherein each action is made up of one or more movements.

36. A system for representing an autonomous winged entity as claimed in claim 35, wherein the motor is controllable by the controller to reciprocate to generate a reciprocating motion in at least one of the wings, wherein the at least one action includes reciprocation of the motor a selected number of times over a selected angular distance at a selected angular speed.

37. A system for representing an autonomous winged entity, comprising:

a vessel having a vessel wall that defines an interior, wherein the interior is viewable from outside the vessel;

a rotational drive system;

a flexible shaft connected to the rotational drive system for rotation by the rotational drive system; and a display object positioned in the interior of the vessel and connected to the flexible shaft at a position that is spaced from the rotational drive system, wherein the display object has a plurality of wings, including a first wing and a second wing, and wherein rotation of the flexible shaft causes the display object to move within the vessel; and a controller, wherein the rotational drive system includes a motor, wherein the controller is configured to cause the motor to carry out a plurality of actions, wherein each action is made up of one or more movements, wherein throughout at least one action the display object remains in contact with the vessel wall as a result of spring tension in the flexible shaft, wherein the motor is controllable by the controller to reciprocate to generate a reciprocating motion in at least one of the wings, wherein the at least one action includes reciprocation of the motor a selected number of times over a selected angular distance at a selected angular speed.

38. A system for representing an autonomous winged entity, comprising:

a vessel having a vessel wall that defines an interior, wherein the interior is viewable from outside the vessel;

a rotational drive system;

a flexible shaft connected to the rotational drive system for rotation by the rotational drive system; and a display object positioned in the interior of the vessel and connected to the flexible shaft at a position that is spaced from the rotational drive system, wherein the display object has a plurality of wings, including a first wing and a second wing, and wherein rotation of the flexible shaft causes the display object to move within the vessel; and a controller, wherein the rotational drive system includes a motor, wherein the controller is configured to cause the motor to carry out a plurality of actions, wherein each action is made up of one or more movements, wherein throughout at least one action the flexible shaft is rotated and the display object remains stationary against the vessel wall as a result of spring tension in the flexible shaft.

39. A system for representing an autonomous winged entity, comprising:

a vessel having a vessel wall that defines an interior, wherein the interior is viewable from outside the vessel;

a rotational drive system;

a flexible shaft connected to the rotational drive system for rotation by the rotational drive system; and a display object positioned in the interior of the vessel and connected to the flexible shaft at a position that is spaced from the rotational drive system, wherein the display object has a plurality of wings, including a first wing and a second wing, and wherein rotation of the flexible shaft causes the display object to move within the vessel; and a controller, wherein the rotational drive system includes a motor, wherein the controller is configured to cause the motor to carry out a plurality of actions, wherein each action is made up of one or more movements, wherein throughout at least one action the display object remains motionless and in contact with the vessel wall as a result of spring tension in the flexible shaft.

40. A system for representing an autonomous winged entity, comprising:

a vessel having a vessel wall that defines an interior, wherein the interior is viewable from outside the vessel;

a rotational drive system;

a flexible shaft connected to the rotational drive system for rotation by the rotational drive system; and a display object positioned in the interior of the vessel and connected to the flexible shaft at a position that is spaced from the rotational drive system, wherein the display object has a plurality of wings, including a first wing and a second wing, and wherein rotation of the flexible shaft causes the display object to move within the vessel; and a controller, wherein the rotational drive system includes a motor, wherein the controller is configured to cause the motor to carry out a plurality of actions, wherein each action is made up of one or more movements, wherein the motor is controllable by the controller to reciprocate to generate a reciprocating motion in at least one of the wings, wherein the at least one action includes reciprocation of the motor a selected number of times over a selected angular distance at a selected angular speed.

* * * * *